US008826796B1

(12) United States Patent
Gonzalez

(10) Patent No.: US 8,826,796 B1
(45) Date of Patent: Sep. 9, 2014

(54) TAPERED V UNDERBODY PROTECTION ENHANCEMENT

(71) Applicant: Rene' G. Gonzalez, Southfield, MI (US)

(72) Inventor: Rene' G. Gonzalez, Southfield, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 109 days.

(21) Appl. No.: 13/756,025

(22) Filed: Jan. 31, 2013

(51) Int. Cl.
*F41H 7/04* (2006.01)
*F41H 7/00* (2006.01)

(52) U.S. Cl.
CPC ..... *F41H 7/00* (2013.01)
USPC ..... 89/36.09; 89/36.07; 89/36.08; 89/929; 89/930

(58) Field of Classification Search
CPC ..... F41H 7/00; F41H 7/02; F41H 7/04; F41H 7/042; F41H 7/044
USPC ..... 89/36.01, 36.07, 36.08, 36.09, 929, 89/930; 296/187.08
See application file for complete search history.

(56) References Cited

U.S. PATENT DOCUMENTS

| | | | | |
|---|---|---|---|---|
| 7,954,419 | B2 * | 6/2011 | Ran et al. | 89/36.08 |
| 7,997,182 | B1 | 8/2011 | Cox | |
| 8,627,757 | B2 * | 1/2014 | Tobie | 89/36.04 |
| 2008/0034953 | A1 * | 2/2008 | Barbe et al. | 89/36.01 |
| 2010/0218667 | A1 | 9/2010 | Naroditsky et al. | |
| 2010/0307329 | A1 | 12/2010 | Kaswen et al. | |
| 2012/0174767 | A1 | 7/2012 | Naroditsky et al. | |
| 2012/0210861 | A1 * | 8/2012 | Tobie | 89/36.04 |
| 2013/0111734 | A1 * | 5/2013 | Allor et al. | 29/525.02 |
| 2014/0026741 | A1 * | 1/2014 | Dunne et al. | 89/36.02 |
| 2014/0060304 | A1 * | 3/2014 | Harmon et al. | 89/36.02 |
| 2014/0130658 | A1 * | 5/2014 | Gonzalez | 89/36.08 |
| 2014/0150633 | A1 * | 6/2014 | Mears et al. | 89/36.02 |

OTHER PUBLICATIONS

Title: Laying up roof trusses: Roof truss principles, Internet article under Timber Plus Toolbox, 1 Page, printed Nov. 19, 2012.

* cited by examiner

*Primary Examiner* — Bret Hayes
*Assistant Examiner* — Derrick Morgan
(74) *Attorney, Agent, or Firm* — David L. Kuhn; Thomas W. Saur; Luis Miguel Acosta

(57) ABSTRACT

A system reducing blast induced vehicle floor oscillation has a hull with brackets whose shoulders face edges of the vehicle sidewalls. The hull has a first position where the shoulders form a vertical gap with these edges and a second, risen position where the shoulders hit the edges. The brackets are connected to the sidewalls so as to permit rise of the brackets and V hull when a blast occurs but hold the V hull in the first position during normal vehicle use. Mounts on the vehicle frame are compressible by a vertical distance and support the cab. Rods of the hull are at another vertical distance from the frame. The sum of the vertical distances is equal to the vertical gap. When a blast occurs, the V hull's rise creates separate force paths from the hull to the floor to reduce floor oscillation.

20 Claims, 5 Drawing Sheets

TAPERED V UNDERBODY PROTECTION ENHANCEMENT

GOVERNMENT INTEREST

The invention described here may be made, used and licensed by and for the U.S. Government for governmental purposes without paying royalty to me.

BACKGROUND OF THE INVENTION

1. Field of the Invention

The invention is within the area of technology associated with protecting vehicles and their occupants from explosions of mines or improvised explosive devices typically encountered by military vehicles in combat zones. Generally this technology involves adding armor to the underside of vehicles and specially shaping the lower hulls of the vehicles; typically armored V-shaped hulls or somewhat V-shaped hulls are used to protect the vehicles and the vehicle occupants. One aspect of the invention herein is a blast shield in the form of a V hull thickest at the vertex and tapering in the outboard direction to brackets which have sliding engagement with sidewalls of the vehicle cab; the V hull and brackets form an integral, one-piece component.

A problem that has been encountered in some vehicle designs is that the floor of the cab or cabin of the vehicle oscillates violently as a result of an under-vehicle explosion. The oscillation is known to injure the occupants of the vehicle, the lower limbs of the occupants being particularly vulnerable to the effects of floor oscillation. The invention herein mitigates blast-induced floor oscillation by controlling the paths of blast forces passed to the floor. Specifically, the invention utilizes an improved system having a V shaped hull as a blast shield that can rise or descend relative to the vehicle frame. When an explosion under the vehicle occurs, the V hull contacts the frame and sidewall so as to divide blast forces into two discrete components travelling along different paths in the vehicle. The discrete force components arrive at the vehicle floor essentially simultaneously at different locations, whereby floor oscillation is reduced.

2. Background Art

It is already known to employ either a truncated V shaped hull or a "shallow V" hull on a vehicle to enhance its ability to resist or survive mine blasts or similar explosions occurring under the vehicle. For example, U.S. Patent Application 2012/0174767 A1 of Naroditsky et al shows a shallow V belly armor plate under a vehicle cab and attached to sidewalls of a vehicle. That reference at paragraph 40 also teaches making the V armor plate thicker at the central portion thereof. U.S. Pat. No. 7,997,182 B1 to Cox shows a V shaped blast shield having ribs and other components reinforcing the vertex zone of the shield. U.S. Patent Application publication 2010/0307329 A1 to Kaswen et al shows an underbody blast shield capable of vertical rise and fall due to shock absorbers connecting the shield to the vehicle.

In addition to the foregoing references, a previous and relevant United States patent application has been filed by the inventor herein. The previous application is entitled "Truncated V Underbody Protection Enhancement," has application Ser. No. 13/677,202 and EFS ID 14232024, and was filed Nov. 14, 2012. The previous application discloses a rigid armor shield configured as a truncated V disposed below the floor of a vehicle cab. First elastomeric isolators are between the shield and vehicle frame members; and second elastomeric isolators are between lateral edges of the shield and the cab's side walls. If an under-vehicle blast occurs, the distance through which the second isolators collapse equals the combined collapsing distance of the first isolators and the cab mounts, whereby blast loads to the shield transfer along separate paths to different zones of the floor so as to decrease oscillation of the floor.

SUMMARY OF THE INVENTION

The invention is a system for reducing oscillation of the vehicle cab floor after an explosive blast under the vehicle. The system includes a one-piece V hull thicker at the vertex than at the outboard edges. The V hull has brackets whose shoulders face lower edges of the cab's sidewalls. The V hull has a first position where the shoulders are spaced by a vertical dimension from the lower edges of the sidewalls, and has a second position where the shoulders contact the lower edges of the sidewalls. Connector plates are mounted to the brackets and the sidewalls such that the brackets and connector plates interleaf between them the lower edges of the sidewalls. First fasteners connect the brackets to the sidewalls and second fasteners connect the connector plates to brackets. The respective fasteners pass through slots which permit vertical movement of the brackets relative to the sidewalls. The first and second fasteners maintain the V hull in the first position during normal vehicle operation but allow movement of the V hull toward second position when blast forces impact the V hull. Body mounts compressible by a first vertical distance are on the vehicle frame to support the cab and transverse tension rods fastened to the V hull are at a second vertical distance from the frame. The sum of the first vertical distance and the second vertical distance essentially equals the vertical dimension between the shoulders of the brackets and the lower edges of the sidewalls. By this arrangement, when a blast occurs beneath the V hull, the V hull rises and creates two separate simultaneous force paths from the V hull to the floor of the cab and thereby floor oscillation is reduced.

DETAILED DESCRIPTION OF THE PREFERRED EMBODIMENT(S)

Definitions and Terminology

Figure 1:
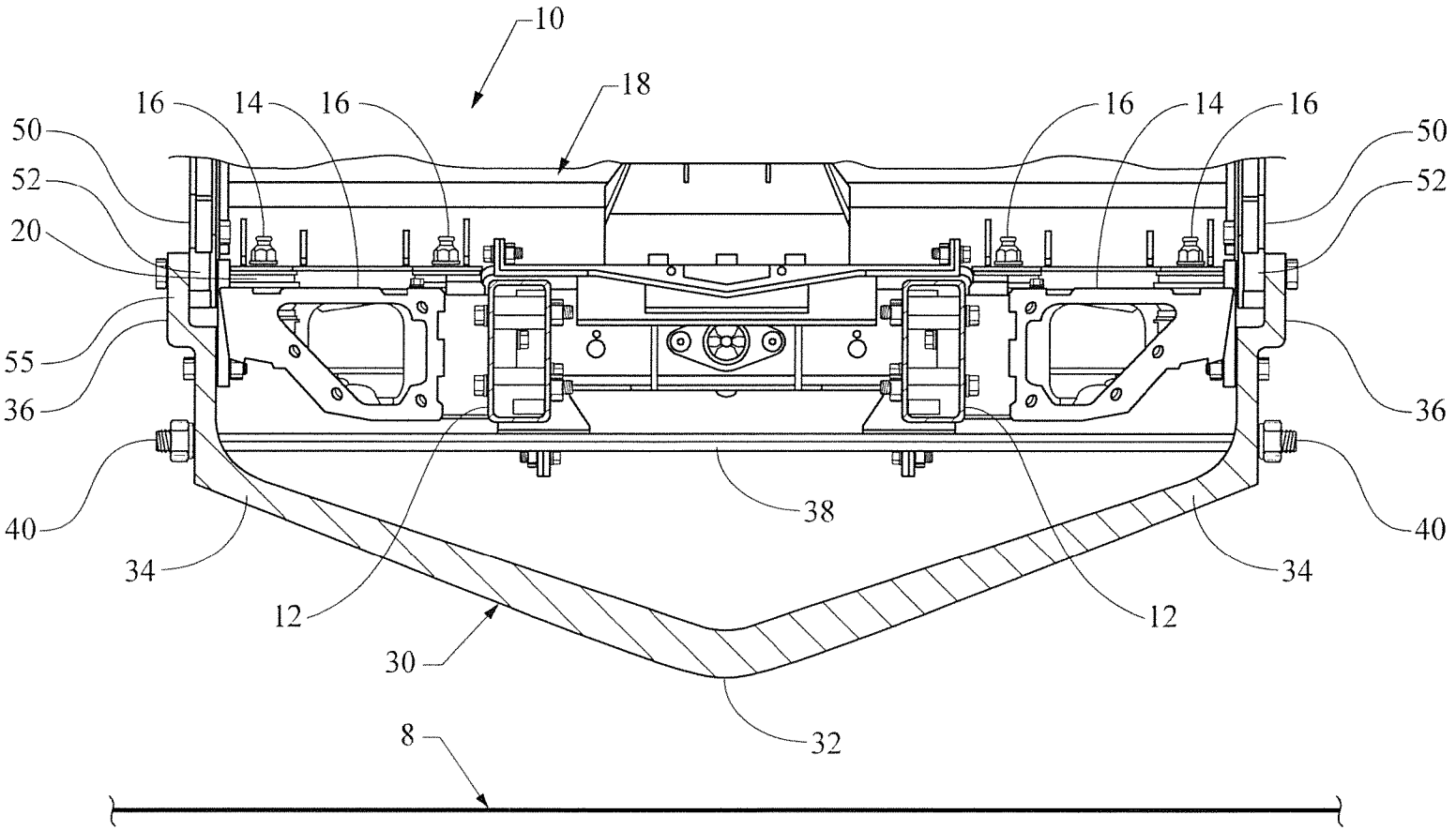
FIG. 1 is a cross sectional view of a lower body area of a ground vehicle equipped with a V hull and associated components.

The following definitions and terminology are applied as understood by one skilled in the appropriate art.

The singular forms such as "a," "an," and "the" include plural references unless the context clearly indicates otherwise. For example, reference to "a material" includes reference to one or more of such materials, and "an element" includes reference to one or more of such elements.

As used herein, "substantial" and "about", when used in reference to a quantity or amount of a material, dimension, characteristic, parameter, and the like, refer to an amount that is sufficient to provide an effect that the material or characteristic was intended to provide as understood by one skilled in the art. The amount of variation generally depends on the specific implementation. Similarly, "substantially free of" or the like refers to the lack of an identified composition, characteristic, or property. Particularly, assemblies that are identified as being "substantially free of" are either completely absent of the characteristic, or the characteristic is present only in values which are small enough that no meaningful effect on the desired results is generated. The phrases "substantially equal" or "essentially equal" when applied to two or more quantities means the desired effect will occur despite slight deviation from exact equality.

Concentrations, values, dimensions, amounts, and other quantitative data may be presented herein in a range format. One skilled in the art will understand that such range format is used for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a size range of about 1 dimensional unit to about 100 dimensional units should be interpreted to include not only the explicitly recited limits, but also to include individual sizes such as 2 dimensional units, 3 dimensional units, 10 dimensional units, and the like; and sub-ranges such as 10 dimensional units to 50 dimensional units, 20 dimensional units to 100 dimensional units, and the like.

Oscillation, as used in this application can include a single motion, such as the rise of a vehicle cab floor and can include the subsequent fall of the floor; oscillation, as used herein can include as a series of oscillating motions and includes motions in any given direction, not just a vertical direction.

For a vehicle, and a system mounted on or used in connection with the vehicle, forward/reverse (longitudinal) and vertical (up/down) directions are generally relative to the vehicle and system as typically operated (e.g., when the vehicle is operated with the respective powertrain in a forward/reverse mode). As such, lateral (left/right) directions are generally perpendicular to the longitudinal/vertical plane, and are referenced from a vehicle operator (e.g., driver) perspective. A first direction (e.g., forward) and a second direction (e.g., rearward or reverse) where the second direction substantially, but not necessarily wholly, opposes the first direction are also generally or used in connection with the vehicle. Likewise, elements located (mounted, positioned, placed, installed, etc.) on, near, or proximate to the vehicle longitudinal center plane are generally referred to as "inner" or "inboard," while elements that are distal or more remote to the vehicle body longitudinal center plane are generally referred to as "outer" or "outboard," unless otherwise noted. As such, inner elements are generally closer to the vehicle longitudinal center plane than outer elements.

Figure 5:
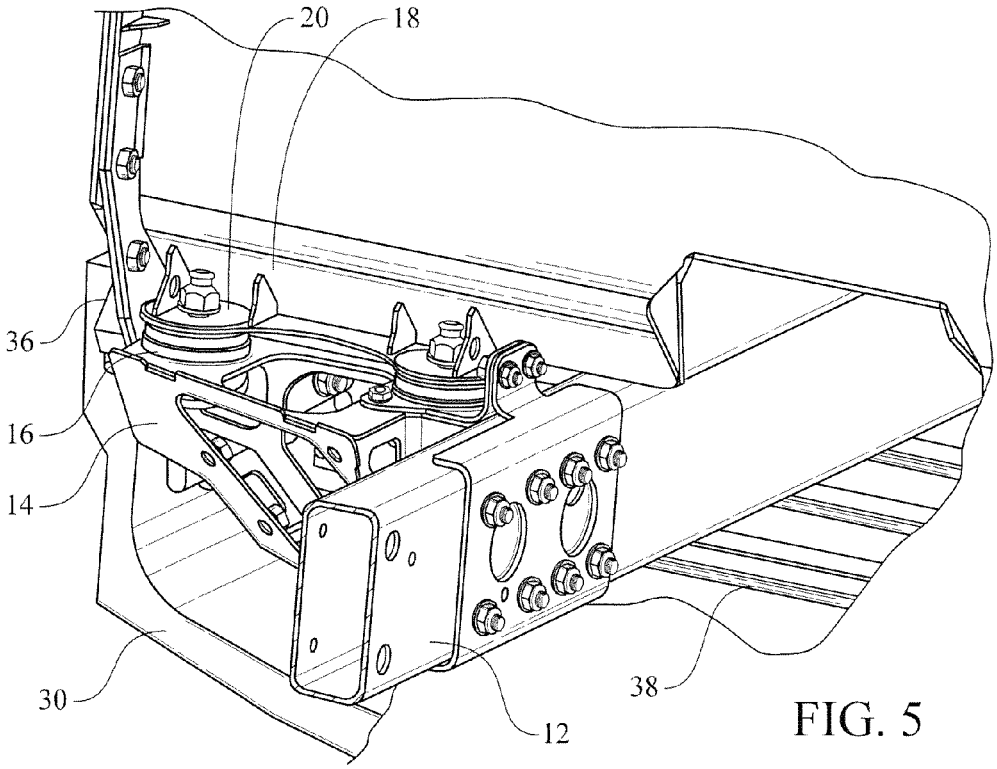
FIG. 5 is a detail view of body mounts supporting the cab on the vehicle frame.
Figure 4:
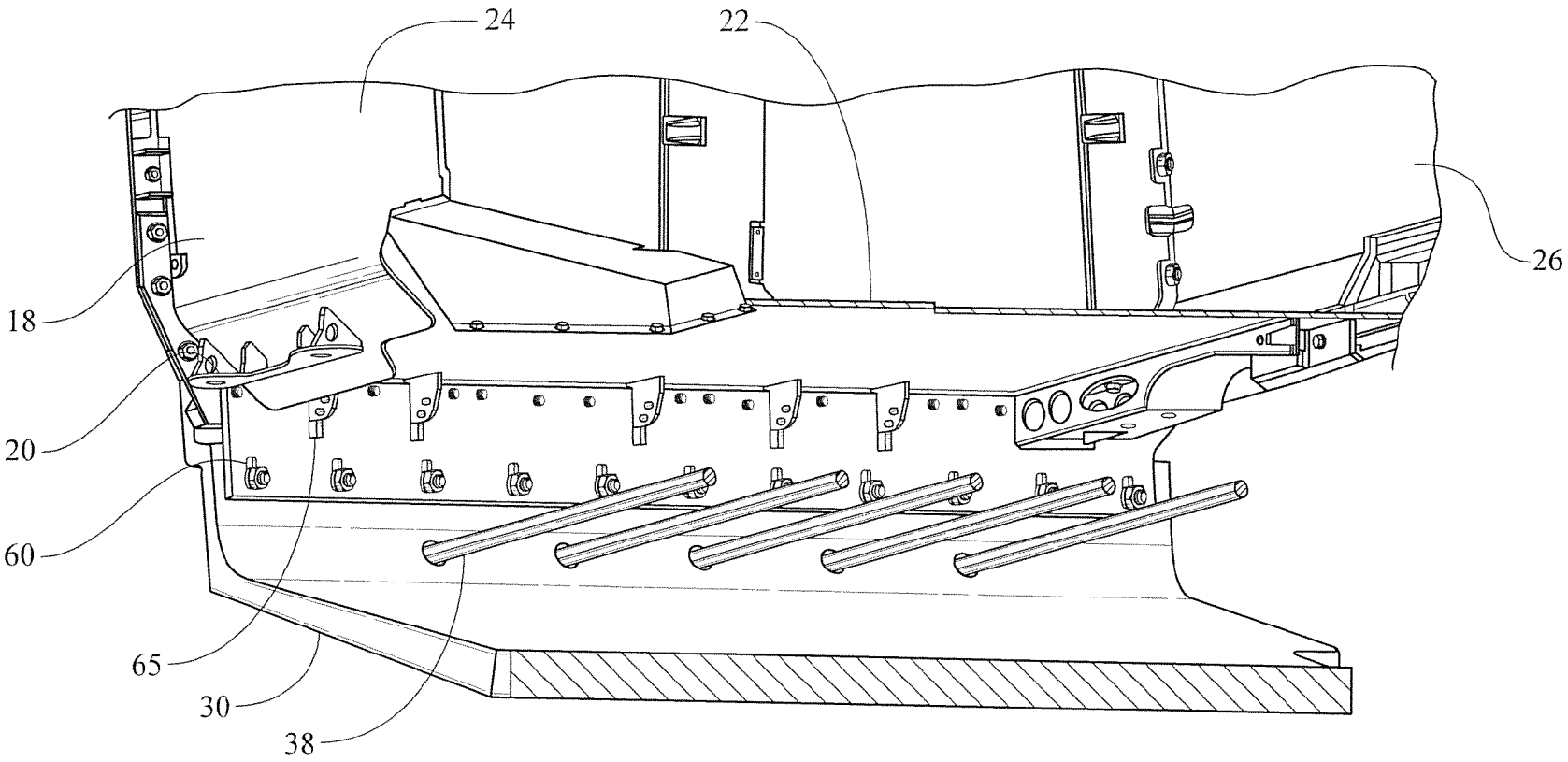
FIG. 4 is a partial perspective view of the vehicle cab sidewalls and floor together with the V hull and associated components.
Figure 6:
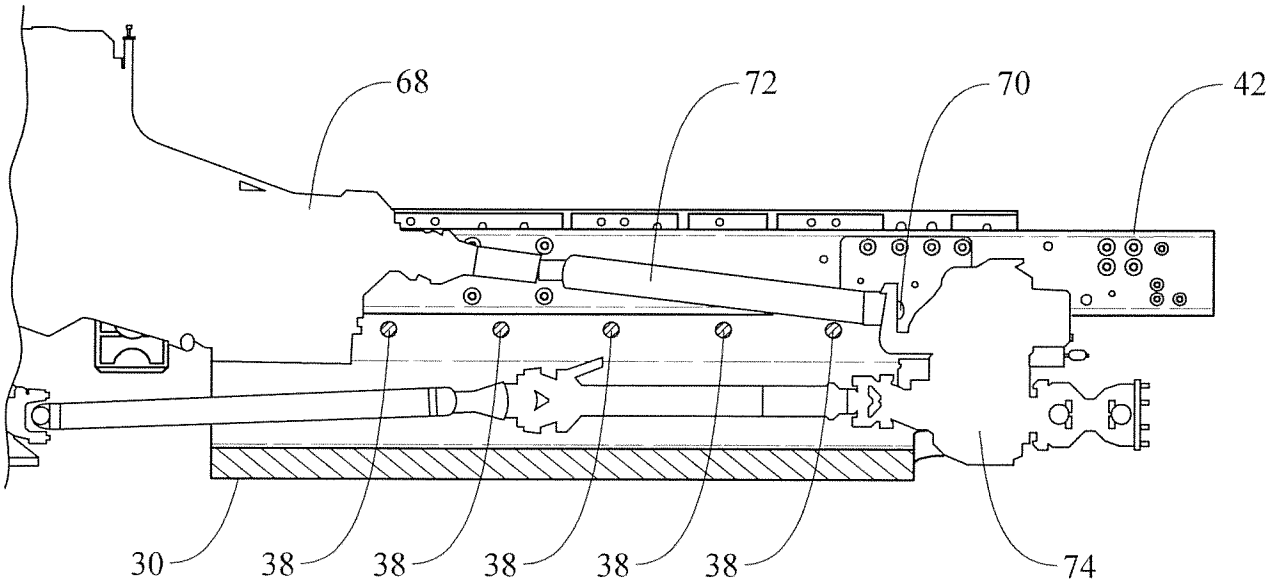
FIG. 6. is a side view of automotive components disposed in the V hull.

An overview of the system to reduce vehicle cab floor rise or oscillation due to under body explosions is seen in FIG. 1. That figure is a cross section of the underbody region of a vehicle 10 located above a ground surface 8. The underbody region is supported on a frame having longitudinal frame members 12 and lateral frame extensions 14 affixed thereto. Fixed upon frame extensions are conventional body mounts 16 which support and connect to cab 18 (partially shown) of the vehicle, the mounts' connection to the frame and cab being shown in greater detail in FIG. 5. As can be seen in FIG. 5 and also FIG. 4, cab 18 has cab mount points such as forward mount points 20 to which mounts 16 are engaged. The cab has a floor section 22 disposed above V hull 30, and has cab forward wall 24 and cab aft wall 26, as seen in FIG. 4.

Returning to FIG. 1, a tapered V hull or blast shield 30 is mounted on the underside of vehicle 10 beneath the longitudinal frame members. V hull 30 is relatively thicker at vertex 32 which will be disposed under the longitudinal axis of the vehicle. The thickness of V hull 30 gradually decreases from vertex 32 in the outboard direction and thus has a tapered cross sectional profile wherein the thinnest portions of V hull 30 are at zones 34 near the hull's outboard edges. By this design, the portions of hull 30 will be thicker and stronger as they are nearer to ground surface 8 where mine blasts or the like occur. It is preferred that V hull 30 be an integral component, meaning that it is comprised of a single piece wherein individual layers, sub plates, shoulders are not assembled or joined to form the V hull, and wherein V hull 30 is formed from a single blank or block of material. The V hull can be made of any material normally used for military vehicle hulls, such as armor grade aluminum or steel, composite armor material but can be made from non armor material as well. As also shown in FIG. 2, somewhat Z-shaped attachment brackets 36 are integrally joined to zones 34 at the outboard edges of hull 30.

As best seen in conjunction with FIGS. 1, 3*a*, 3*b* and 6, a set of transverse structural members preferably in the form of tension rods 38 extend laterally across V hull 30. Tension rods 38 are fastened at either end to attachment brackets 36 by any suitable means, such as nuts 40. Tension rods 38 stiffen V hull 30 and act as a mechanism to transfer blast forces impinging the V hull to vehicle frame members 12 when the V hull rises during an underbody blast, as will be explained more fully later in this application. The tension rods are relatively slender, typically but not necessarily having diameters in the range of 0.75 inches to 2.0 inches; the diameters can be larger or smaller in particular applications. The tension rods are easily removed and replaced, and can be positioned so as to pass between or otherwise accommodate automotive components disposed above V hull 30. For example in FIG. 6, tension rods 38 are placed so as to avoid interference with transmission 68 and the connection 70 between drive shaft 72 and transfer case 74. The slender diameter of the rods and their ability to be positioned to accommodate automotive components make the rods more advantageous than relatively heavier, bulkier fixed-position braces or ribs typically used to reinforce underbody blast shields. It may be preferred in some applications to have rods of rectangular cross sectional shape or other cross sectional shape. It may be desired to have flat upper surfaces of the rods faced toward frame members 12 to avoid stress risers when the rods strike the frame members.

Tension rods 36 complete a strong, rigid triangular truss structure with V hull 30 and these rods are under tension when blast shield or V hull 30 undergoes a blast load. When an under-vehicle explosive blast occurs, the tension rods contact longitudinal frame members 12 and cause a distribution of the load over a set of contacts between the rods and the frame members. This distribution prevents failure of frame members 12 due to stress concentration thereon; the distribution avoids undesirably high load rates which can cause frame members to fail before the maximum load occurs. Additionally, rods 38, because they are slender and under tension, will give or deform slightly but sufficiently to reduce stress rate or load rate as the rods strike frame members 12 so as to avoid premature failure of the frame members. That is, the deflection or deformation of the rods will reduce the rate of vertical load transmission to longitudinal frame members 12. This is important since automotive frame material is often stress rate sensitive, failing at lower loads when subjected to higher loading rates.

Figure 2:
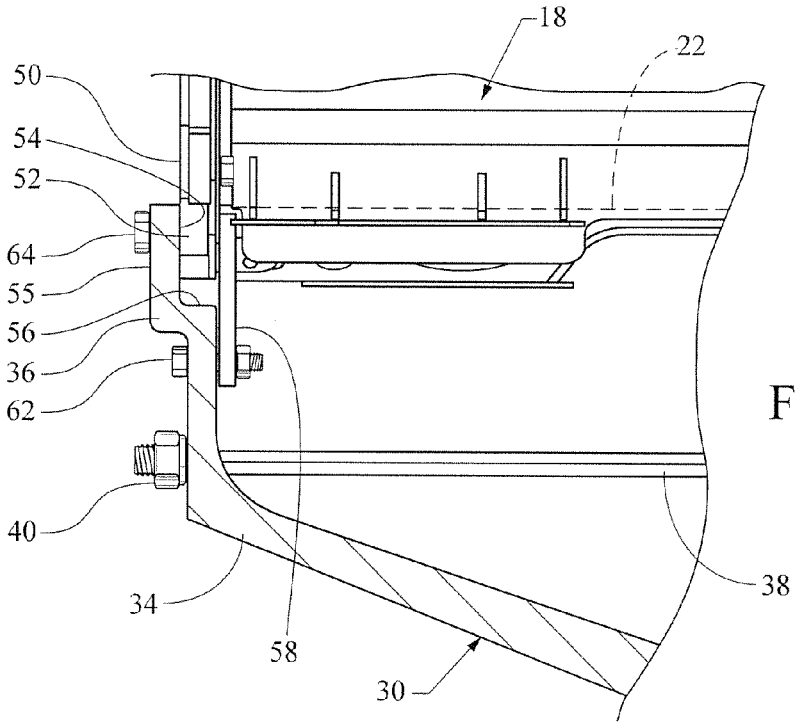
FIG. 2 is a detail view depicting the connection of the V hull to a sidewall of the vehicle.
Figure 3A:
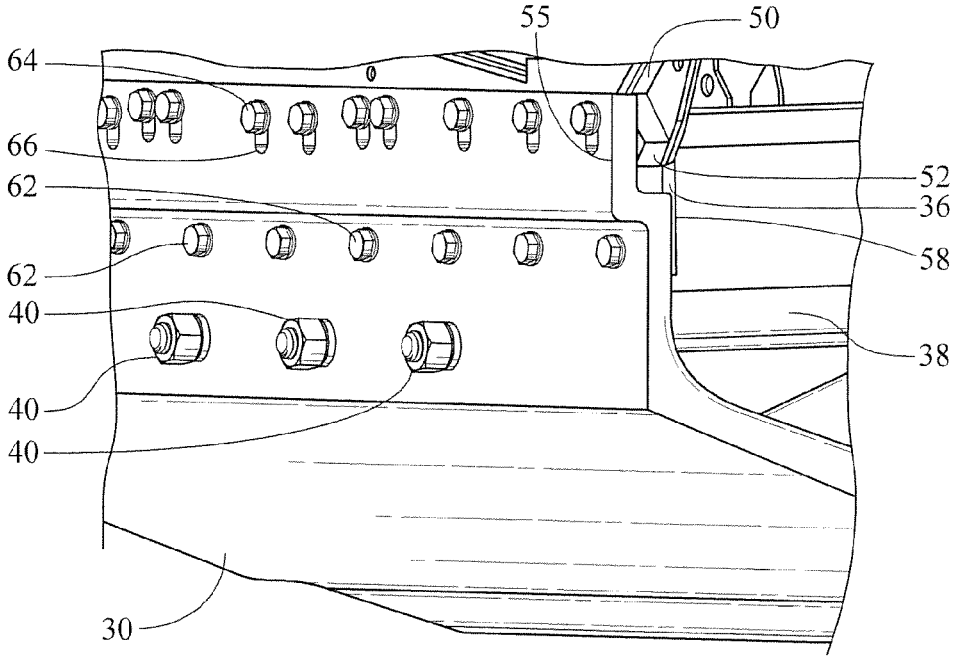
FIGS. 3*a* and 3*b* are further detail views depicting the connection of the V hull to a sidewall of the vehicle.
Figure 3B:
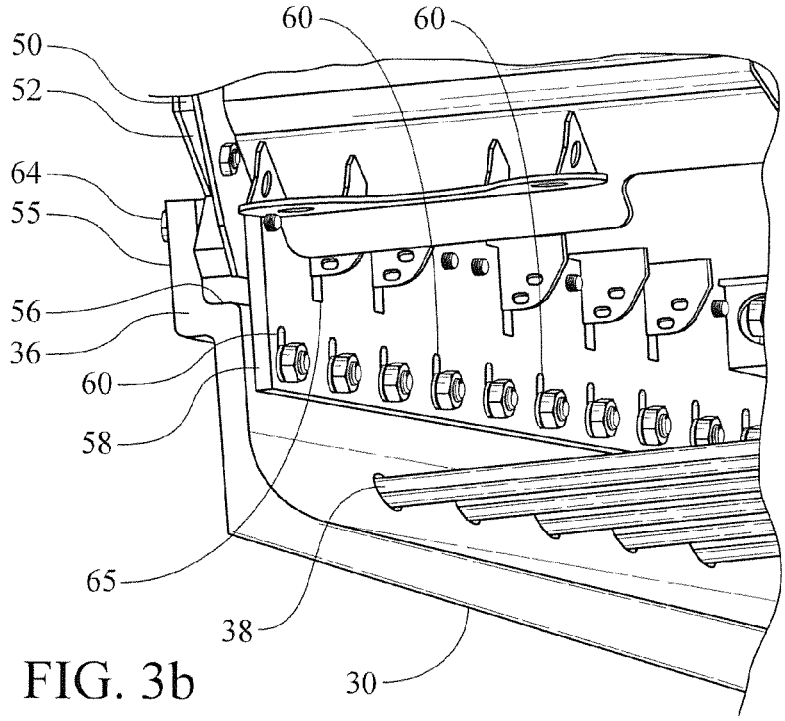

The structure by which V hull 30 is connected to sidewalls 50 of the vehicle is shown in FIG. 1 but certain details of that structure are understood more easily in conjunction with FIGS. 2, 3*a* and 3*b*. It will be noted that sidewalls 50 each define at their bases a notched or indented foot zone 52. As best seen in FIG. 2, foot zone 52 faces against an inboard surface 54 of a flange 55 of bracket 36, surface 54 being disposed adjacently above shoulder surface 56 of the bracket. Brackets 36 are in sliding contact with sidewalls 50 and as seen in FIG. 3*a* the brackets are connected by bolts 64 or other conventional fasteners to the sidewalls at vertical slots 66 of the brackets.

Facing on the sidewalls are connector plates 58 positioned such that the connector plates and the flanges closely sandwich or interleaf therebetween the lower portions of sidewalls 50. Connector plates define first rows of vertically oriented slots 60 along their lower edges so as to permit upward movement of brackets 36 and V hull 30 relative to the connector plates.

Brackets 36 are fastened at slots 60 to plates 58 by bolts 62 or other conventional fasteners which hold brackets 36 tightly enough to the plates so that brackets 36 and tapered V hull 30 do not rise relative to the plate during normal vehicle operation. However, slots 60 permit sliding of V hull 30 upward relative to the plate when an explosion occurs beneath V hull 30. As with bolts 62, other bolts 64 hold the brackets and sidewall together tightly enough such that brackets 36 and tapered V hull 30 do not rise relative to the sidewalls during normal vehicle operation. However, vertical slots 66 permit sliding of V hull 30 upward relative to the sidewalls when an explosion occurs beneath V hull 30.

As a result of the structure described above, V hull 30 during normal vehicle operation remains stationary relative to plates 58 and sidewalls 50, and hull 30 does not rise toward longitudinal frame members 12. Conversely, during an underbody explosion, V hull 30 will rise relative to plate 58, sidewalls 50 and longitudinal frame members 12. During normal vehicle travel, especially during travel over rough terrain, the frame and sidewalls of the vehicle can twist or deform as usual and desired without impairment by the rigidity of V hull 30.

Slots 60 and 66 have vertical dimensions such that the distance which brackets 36 allow V hull 30 to rise is equal to or substantially equal to the sum of: the vertical distance between tension rods 38 and longitudinal frame members, the vertical deflection of rods 38 when they strike frame members 12 and the vertical compression of mounts 16. It will be noted that the vertical deflection of rods 38 will typically, though not necessarily, be so small in relation to the other distances that it can, as a practical matter, be disregarded. In any event, when an explosive blast occurs beneath vehicle 10 and V hull 30 rises, force from the blast is transmitted simultaneously along two paths from V hull 30 to different zones of cab floor 22. One path is through sidewalls 50 and thence to floor 22 and the other path is through the vehicle frame and then through mounts 16 and thence to cab floor 22. The result of having forces arrive simultaneously at the different zones of floor 22 is that the floor has a smaller rise with respect to the cabin as a result of the blast, which reduces the injury to the lower limbs of vehicle occupants whose feet are on the floor (or on a floor-mat which rests on the floor). In another manner of speaking, the violent oscillation (or rapid rise during through one or more cycles) of floor 22 is reduced when an underbody blast occurs.

There is a de-concentrating effect on floor oscillation due to the above-described sandwiching or interleafing engagement of connector plates 58 and flanges 55 with sidewalls 50, which causes the movement of V hull 30 to be vertically guided as it moves relative to the sidewalls. This vertical-guide engagement, together with the rigidity of V hull 30 as enhanced by tension rods 38, means that all portions of V hull 30 will rise substantially equally wherever an explosive blast occurs under the vehicle. Thus the V hull causes transfer of blast loads to different zones of floor 22 equally no matter where the blast occurs under the vehicle; thus the V-hull negates the tendency for blasts under one side of the vehicle to more greatly affect the floor zone on that side of the vehicle.

It will happen occasionally that a vehicle travelling over rough terrain will encounter objects that strike the underside of the vehicle with sufficient force to move V hull 30 upward from its normal, completely down position shown in FIG. 1. Bolts 62 and 64 will tend to hold V hull 30 in the new, more upward position via frictional forces. However as the vehicle continues to travel over the terrain, the frame of the vehicle continues to twist so that portions of longitudinal frame members 12 will make contact with and push downward on tension rods 38. The holding force of bolts 62 and 64 is small enough to permit downward movement of V hull 30 as the vehicle frame twists so that V hull 30 returns to its normal, completely down position. Thus the system of which the V hull is part is self adjusting in that the system returns the V hull to its normal position if the V hull has been pushed upward during vehicle operation.

Various alterations and modifications will become apparent to those skilled in the art without departing from the scope and spirit of this invention and it is understood this invention is limited only by the following claims.

What is claimed is:

1. For a vehicle having a cab and a floor of the cab, an improved system for reducing the rise of the floor as a result of an explosive blast under the vehicle, the system comprising:

a hull;

brackets of the hull;

sidewalls of the cab;

shoulders of the brackets facing toward edges of the sidewalls, the hull having a first juxtaposition with the sidewalls wherein the shoulders are spaced by a vertical dimension from the edges of the sidewalls, the hull having a second juxtaposition with the sidewalls wherein the shoulders contact the edges of the sidewalls;

a frame of the vehicle;

body mounts on the frame supporting the cab of the vehicle, the body mounts compressible through a first vertical distance;

transverse structural members extending across the hull and disposed at a second vertical distance from the frame;

wherein the sum of the first vertical distance and the second vertical distance substantially equals the vertical dimension between the shoulders of the brackets and the edges of the sidewalls.

2. The system of claim 1 further comprising means for guiding vertical movement of the hull, the guiding means comprising:

flanges on the brackets;

connector plates connected to the sidewalls and the brackets;

wherein the edges of the sidewalls are between the connector plates and the flanges.

3. The system of claim 2 further comprising a sliding connection between the flanges and the sidewalls, comprising:

flange slots defined in the flanges;

flange fasteners engaging the flanges and sidewall, the flange fasteners passing through the flange slots.

4. The system of claim 3 wherein the sliding connection is a first sliding connection, the system further comprising a second sliding connection, which is between the brackets and the connector plates, the second sliding connection itself comprising:

plate slots in the connector plates;

bracket fasteners engaging the brackets and the connector plates, the bracket fasteners passing through the plate slots.

5. The system of claim 1 wherein:

the transverse structural members are tension rods fastened to the hull and extending thereacross;

the rods deflect a third vertical distance upon striking the frame; and the sum of the first, second and third vertical distances is substantially equal to equals the vertical dimension between the shoulders of the brackets and the edges of the sidewalls.

6. The system of claim 5 wherein the tension rods are removeable from the hull.

7. The system of claim 6 wherein the vehicle includes automotive components disposed in the hull, the tension rods being selectively placed to avoid interference with the automotive components.

8. The system of claim 5 wherein the tension rods and the hull form a rigid truss structure.

9. The system of claim 1 further comprising means for urging the hull from the second juxtaposition toward the first juxtaposition, the urging means comprising longitudinal frame members of the frame;

portions of the longitudinal frame members rising and lowering as the frame twists during vehicle operation;

whereby movement of the portions forces the hull downward when the hull is in the second juxtaposition.

10. The system of claim 1 wherein the hull is a V shaped blast shield comprised of a single body, the hull being thicker at a central vertex portion disposed generally parallel to a longitudinal axis of the vehicle, the hull tapering in thickness from the vertex portion in an outboard direction.

11. The system of claim 10 wherein the brackets are generally Z shaped brackets integral with the hull and disposed at outboard edges of the V hull.

12. The system of claim 1 further comprising means for de-concentrating the effect on the floor of the cab of an explosive blast under one side of the vehicle.

13. For a vehicle having a cab and a cab floor, an improved system for reducing the oscillation of the floor as a result of an explosive blast under the vehicle, comprising:

a V hull;

brackets of the V hull;

sidewalls of the cab;

shoulders of the brackets facing lower edges of the sidewalls, the V hull having a first position wherein the shoulders are spaced by a vertical dimension from the lower edges of the sidewalls, the V hull having a second position wherein the shoulders contact the lower edges of the sidewalls;

flanges on the brackets, the flanges facing the sidewalls;

first fasteners connecting the flanges to the sidewalls;

first openings in the flanges through which the first fasteners pass, the first openings allowing movement of the V hull from the first position toward the second position;

connector plates connected to the brackets and the sidewalls such that the flanges and connector plates interleaf therebetween the lower edges of the sidewalls;

second fasteners connecting the connector plates to the brackets;

the connector plates defining second openings through which the second fasteners pass, the second openings allowing movement of the V hull from the first position toward the second position;

wherein the first and second fasteners maintain the V hull in the first position during normal vehicle operation but allow movement of the V hull toward second position when blast forces impact the V hull;

a frame of the vehicle;

longitudinal members of the frame;

body mounts on the frame supporting the cab, the body mounts compressible through a first vertical distance;

tension rods fastened to the V hull and extending thereacross, the tension rods being disposed at a second vertical distance from the longitudinal frame members;

wherein the sum of the first vertical distance and the second vertical distance essentially equals the vertical dimension between the shoulders of the brackets and the lower edges of the sidewalls;

whereby when a blast occurs beneath the V hull, the V hull rises and creates two separate force paths from the V hull to the floor of the cab.

14. The system of claim 13 wherein the force paths comprise one force path through the frame and body mounts to the cab floor and another force path from the V hull to the sidewalls and thence to the cab floor.

15. The system of claim 13 wherein the tension rods and the V hull form a rigid truss structure.

16. The system of claim 13 further comprising means for urging the V hull from the second position toward the first position, the urging means comprising longitudinal frame members of the frame;

portions of the longitudinal frame members, the portions rising and lowering as the frame twists during vehicle operation;

whereby movement of the portions forces the rods and the V hull downward when the V hull has risen from the first position.

17. For a ground vehicle having a passenger cab suitable for human occupants wherein the occupants rest their feet on a floor of the cab or on a floor-mat which rests on the floor, an improved system for reducing the rise of the floor as a result of an explosive blast occurring under the vehicle and thereby reducing injury to lower limbs of the occupants, the system comprising:

a blast shield in the form of a V hull, the V hull being thicker at a central vertex portion disposed generally parallel to a longitudinal axis of the vehicle, the V hull tapering in thickness from the vertex portion in an outboard direction, the V hull being formed as a single body;

generally Z shaped brackets of the V hull integral therewith at outboard edges of the V hull;

shoulders of the brackets facing toward lower edges of sidewalls of the cab, the V hull having a first juxtaposition with the sidewalls wherein the shoulders are spaced by a vertical dimension from the lower edges of the sidewalls, the V hull having a second juxtaposition with the sidewalls wherein the shoulders contact the lower edges of the sidewalls;

a flange on each of the brackets connected to a respective one of the shoulders, the flanges being in facial contact with the sidewalls;

first bolts connecting the flanges to the sidewalls;

vertically oriented first slots in the flanges through which the first bolts pass, the first slots allowing movement of the V hull from the first juxtaposition with the sidewalls toward the second juxtaposition wherein the first bolts hold the V hull in the first juxtaposition during normal vehicle operation;

connector plates fastened at lower portions thereof to the brackets at a lower location below the shoulders, upper portions of the connector plates connected to the sidewalls such that the flanges and the connector plates sandwich therebetween the lower edges of the sidewalls;

second bolts fastening the lower portions of the connector plates to the lower locations of the brackets;

the connector plates defining vertically oriented second slots through which the second bolts pass, the second bolts allowing movement of the V hull from the first juxtaposition toward the second juxtaposition;

wherein the first and second bolts maintain the V hull in the first juxtaposition during normal vehicle operation but allow movement of the V hull toward second juxtaposition when blast forces impact the V hull;

frame members of the vehicle;

body mounts on the frame members supporting the cab of the vehicle, the body mounts compressible through a first vertical distance;

transverse tension rods fastened to the V hull and extending thereacross, the tension rods being removeably fastened to the V hull and disposed at a second vertical distance from the longitudinal frame members, wherein the rods deflect a third vertical direction upon striking the frame;

wherein the sum of the first, second and third vertical distances is substantially equal the vertical dimension between the shoulders of the brackets and the edges of the sidewalls; and whereby when a blast occurs beneath the V hull, the V hull rises and simultaneously creates two force paths from the V hull to the floor of the cab, one force path being through the frame members and body mounts to the cab floor, the other force path being from the V hull through the sidewalls to the cab floor.

18. The system of claim 17 wherein the vehicle includes automotive components disposed above the V hull, the tension rods being selectively placed to avoid interference with the automotive components.

19. The system of claim 17 further comprising means for urging the V hull from the second juxtaposition toward the first juxtaposition, the urging means comprising longitudinal frame members of the frame;

portions of the longitudinal frame members rising and lowering as the frame twists during vehicle operation over terrain;

whereby movement of the portions forces the rods and the V hull downward when the V hull is in the second juxtaposition.

20. The system of claim 19 wherein the rods are under tension and form with the V hull rigid triangular truss structure.

* * * * *